US007401635B2

(12) United States Patent
Grützner

(10) Patent No.: US 7,401,635 B2
(45) Date of Patent: Jul. 22, 2008

(54) DEVICE FOR PROVIDING SHADE INSIDE ROOMS

(75) Inventor: Hans Grützner, Kehrsatz (CH)

(73) Assignee: Silent Gliss International AG, Gumligen (CH)

( * ) Notice: Subject to any disclaimer, the term of this patent is extended or adjusted under 35 U.S.C. 154(b) by 349 days.

(21) Appl. No.: 10/518,195

(22) PCT Filed: Jun. 12, 2003

(86) PCT No.: PCT/CH03/00372

§ 371 (c)(1),
(2), (4) Date: Dec. 16, 2004

(87) PCT Pub. No.: WO03/106782

PCT Pub. Date: Dec. 24, 2003

(65) Prior Publication Data

US 2006/0016567 A1 Jan. 26, 2006

(30) Foreign Application Priority Data

Jun. 18, 2002 (EP) ..... 02405498

(51) Int. Cl.
*E05F 11/00* (2006.01)

(52) U.S. Cl. ..... 160/193; 160/201

(58) Field of Classification Search ..... 160/172 R, 160/168.1 R, 176.1 R, 178.3, 201, 193, 206, 160/196.1, 199, 174 R, 174 V, 176.1 V
See application file for complete search history.

(56) References Cited

U.S. PATENT DOCUMENTS

| | | | | | |
|---|---|---|---|---|---|
| 1,993,173 | A | * | 3/1935 | Kuyper | 160/168.1 R |
| 3,265,117 | A | * | 8/1966 | Anderle et al. | 160/174 R |
| 3,646,986 | A | * | 3/1972 | Anderle | 160/168.1 R |
| 4,462,452 | A | * | 7/1984 | Oskam | 160/176.1 R |
| 4,552,196 | A | * | 11/1985 | Vecchiarelli | 160/174 R |
| 4,593,738 | A | * | 6/1986 | Chi Yu | 160/176.1 R |
| 5,309,974 | A | * | 5/1994 | Fraser | 160/176.1 R |
| 5,595,231 | A | * | 1/1997 | Marocco | 160/168.1 R |
| 6,644,377 | B1 | * | 11/2003 | Lewis | 160/176.1 R |

FOREIGN PATENT DOCUMENTS

| | | |
|---|---|---|
| CH | 276 958 A | 8/1951 |
| DE | 41 33 994 A1 | 4/1993 |

* cited by examiner

*Primary Examiner*—Blair M. Johnson
(74) *Attorney, Agent, or Firm*—The Webb Law Firm

(57) ABSTRACT

The invention relates to a device having a plurality of parallel lamellae and an actuating device. The lamellae can be brought together to form a packet and connected to a pivoting element for pivoting purposes. The pivoting element has a first end and a plurality of other ends which are respectively connected to a lamella. When a lamella is pulled, the lamellae are pivoted in a common plane by the pivoting element. Preferably, the lamellae are respectively pivotably mounted on the upper, essentially horizontal edge thereof.

12 Claims, 5 Drawing Sheets

DEVICE FOR PROVIDING SHADE INSIDE ROOMS

BACKGROUND OF THE INVENTION

1. Field of the Invention

The invention relates to a device for providing shade inside rooms, having a plurality of lamellae oriented parallel to one another, and having an actuating arrangement by means of which the lamellae can be pivoted, and having a retaining arrangement on which the lamellae are mounted.

2. Description of the Related Art

Modern buildings often have very large glass roofs. For these, it is usually necessary to have a shade-providing device which can be arranged externally or internally. As an alternative to a shade-providing arrangement, the use of reflective or metal-coated glass is also known. Such glass, however, is always accompanied by a loss in brightness; the room or space beneath the roof is thus usually darkened to too pronounced an extent.

Providing shade externally is often undesirable for esthetic reasons. The device, in addition, is exposed to weathering and requires comparatively high-outlay maintenance. Devices for providing shade internally need the room to be climatically controlled and ventilated to a relatively pronounced extent. One difficulty with providing shade internally, in addition, is the heat transmission into the interior and the build-up of heat in the narrow interspace between the roof and the device. In addition, in the case of severe heat, cracks may appear in the glass.

The object of the invention is to create a device of the abovementioned type which is intended for providing shade inside rooms and avoid the abovementioned difficulties. In addition, the intention is for the device to be capable of being realized essentially from fabric and also to meet stringent esthetics-related requirements.

The object is achieved, in the case of a device of the generic type, in that the lamellae can be gathered into a group, and in that the lamellae are connected, for pivoting purposes, to a pivoting mechanism which has a first end and a plurality of further ends which are each connected to a lamella such that, as the lamellae are being drawn out, they are pivoted into a common plane by the pivoting mechanism.

SUMMARY OF THE INVENTION

The device according to the invention allows the lamellae to be gathered into a group and, in addition, to be pivoted by means of a pivoting mechanism. The pivoting mechanism is connected to each lamella. This allows precise guidance and thus orientation of the lamellae in each pivoting position. The lamellae may be formed from webs of fabric and thus in a very straightforward manner. The device according to the invention is suitable, in particular, for large glass roofs.

According to a development of the invention, it is provided that the lamellae are mounted in a pivotable manner in each case at a top and essentially horizontal edge. The lamellae here can be pivoted, for example, into a vertical plane. This allows the maximum through-passage of light in the case of external light being diffused. In the case of pronounced irradiation, the lamellae can be pivoted into the plane of the glass roof and direct solar irradiation can thus be avoided.

According to a development of the invention, it is provided that the abovementioned plurality of further ends of the pivoting mechanism are fastened on a lamella in each case at a bottom edge. This allows particularly high stability and guidance of the lamellae. The pivoting mechanism thus acts on the bottom edge of the lamellae in each case.

According to a development of the invention, the pivoting mechanism is produced from tapes. This allows very cost-effective production and a significant saving in weight.

Further advantageous features can be gathered from the dependent patent claims, the following description and the drawing.

BRIEF DESCRIPTION OF THE DRAWINGS

An exemplary embodiment of the invention is explained in more detail hereinbelow with reference to the drawing, in which.

DETAILED DESCRIPTION OF THE INVENTION

FIGS. 1 to 4 each show a building 14 with an interior 3 which is covered over by a glass roof 13. The glass roof is inclined in FIGS. 1 to 4, but it may also be horizontal.

Figure 1:
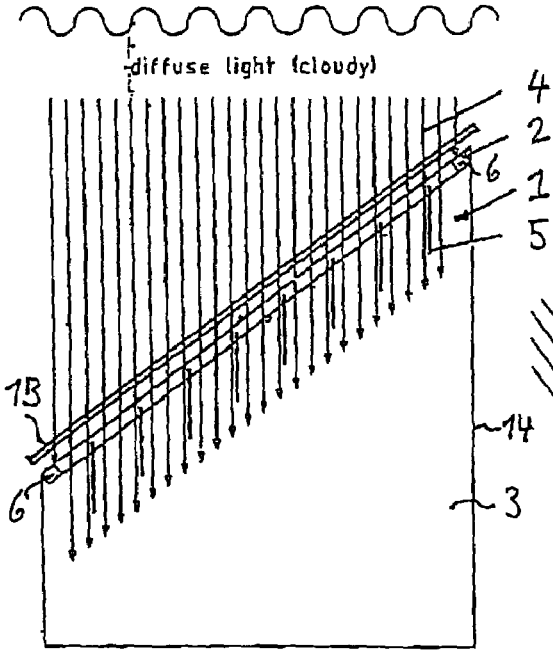
FIG. 1 shows, schematically, a view of a device according to the invention, the lamellae being oriented vertically.
Figure 2:
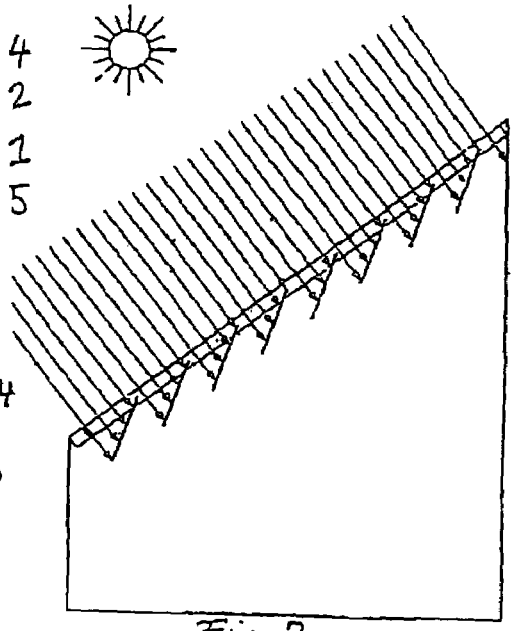
FIG. 2 shows a further view of the device according to the invention, the lamellae being pivoted.
Figure 3:
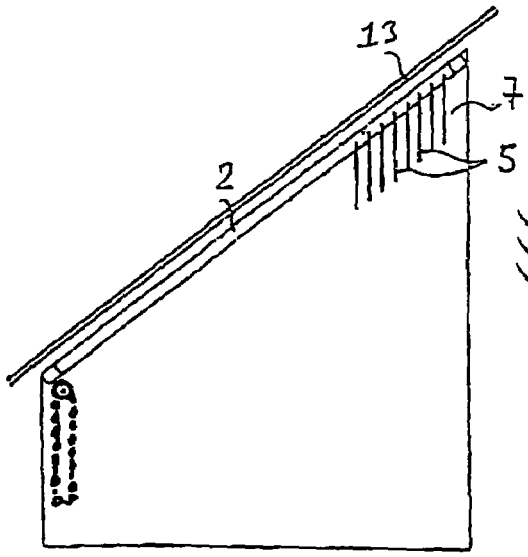
FIG. 3 shows a further view of the device according to the invention, the lamellae being gathered into a group.
Figure 4:
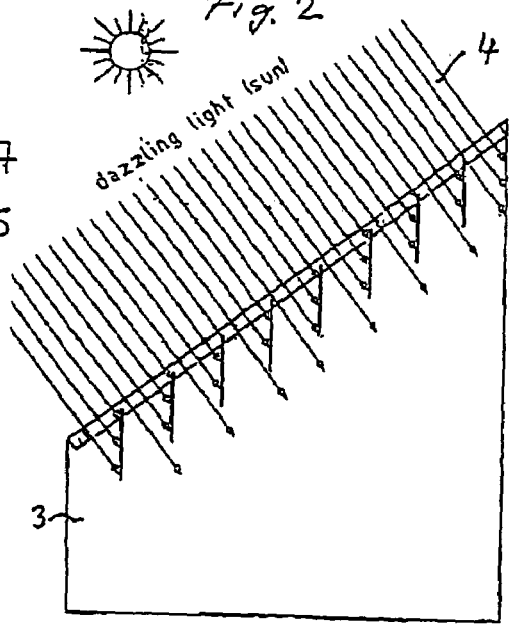
FIG. 4 shows, schematically, a further view of the device according to the invention in the case of direct solar irradiation.

A device 1 for providing shade within the interior 3 is arranged on the underside of the glass roof 13. This device 1 has two parallel, spaced-apart guide rails 2 which are connected to one another at their ends in each case by a cross-member 6. The rails 2 may be fastened directly on the glass roof 13 or on a building wall. The lamellae 5 are guided displaceably in the guide rails 2 at their ends. The displacement takes place by means of a pulling arrangement. Such arrangements are known per se to the person skilled in the art. For example, the lamellae 5 may be displaced by means of a bead chain, such as shown for example in FIG. 3. a toothed belt or a spindle. The displacement can take place by hand or a motor. In FIG. 3, the lamellae 5 are gathered into a group 7. In FIGS. 1, 2 and 4, in contrast, the lamellae 5 are drawn out to the full extent. In FIG. 1, they are oriented vertically and allow optimum incidence of diffuse light into the interior 3. In FIG. 2, the lamellae 5 are pivoted and prevent the direct irradiation of sunlight, although they nevertheless allow diffuse light to enter into the interior 3. In FIG. 4, the lamellae 5 are oriented vertically and, in the case of direct solar irradiation, allow some of the light 4 to enter directly into the interior 3.

Figure 8:
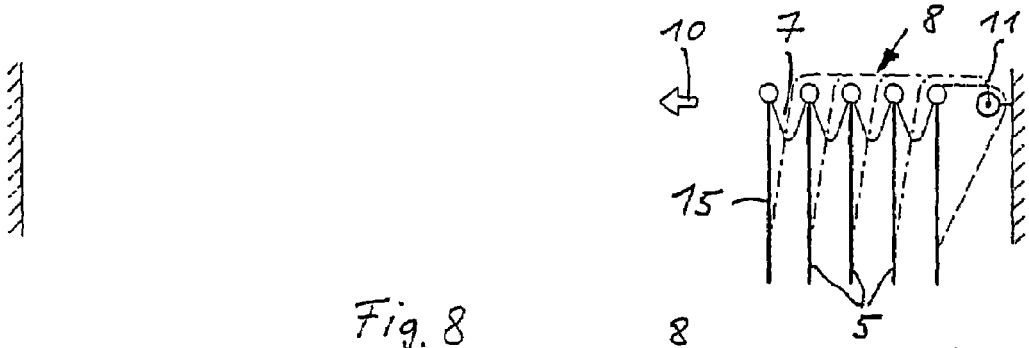
FIG. 8 shows, schematically, a view of the pivoting mechanism and of the lamellae, the latter being gathered into a group.
Figure 9:
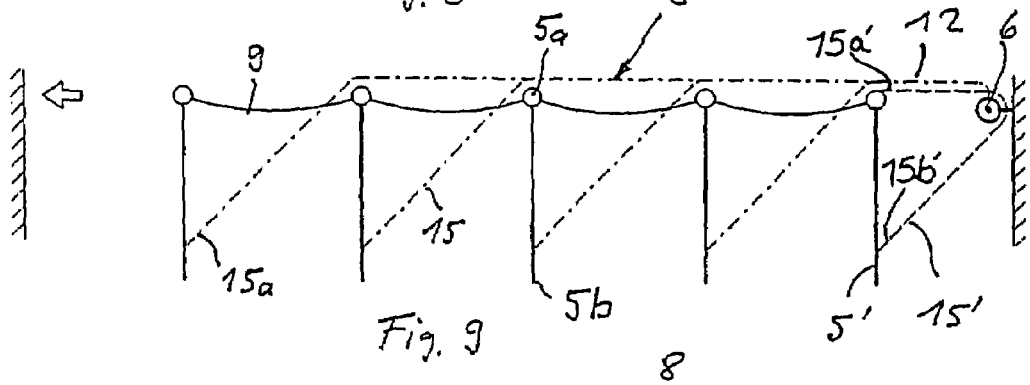
FIG. 9 shows a further schematic view of the pivoting mechanism, the lamellae hanging vertically.
Figure 10:
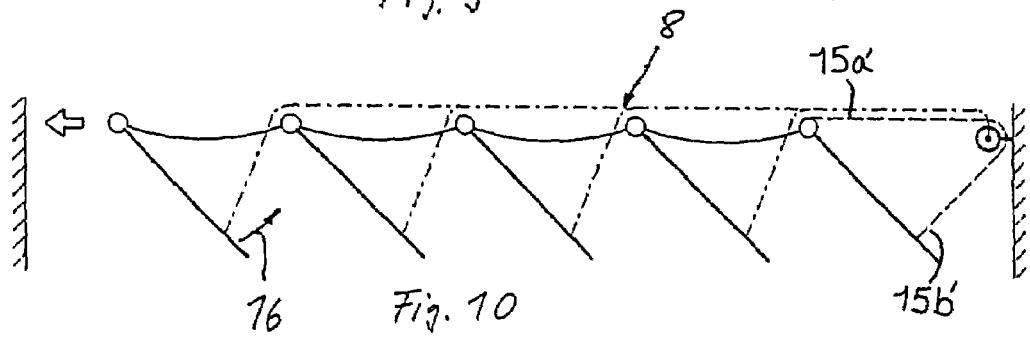
FIG. 10 shows a further view of the pivoting mechanism, the lamellae being inclined in relation to the roof surface.

The lamellae 5 are pivoted by means of the pivoting mechanism 8 shown in FIGS. 8 to 10. This mechanism is preferably produced from tapes and fixed at one end 11. For example, the end 11 may be fastened on one of the crossmembers 6 or on a building wall. The pivoting mechanism 8 has a plurality of tapes 15 which are connected to form a common strand 12. The tapes 15 are connected at a front end 15*a* in each case to a bottom edge 5*b* of a lamellae 5. In the position according to FIG. 8, the device 1 has not been drawn out to the full extent. The tapes 15 are not tensioned and the lamellae 5 are oriented vertically and can be pivoted at a top edge 5*a* in each case. If the lamellae 5 are displaced in the direction of the arrow 10 by means of the abovementioned pulling mechanism, then the tapes 15 are tensioned. The lamellae 5 are thus pulled to the right at the bottom edge 5*b* in each case. The lamellae 5 are thus pivoted about their top edge 5*a* in each case in the direction of the arrow 16. If pulling is continued in the direction of the arrow 10, then the lamellae 5 finally reach the position according to FIG. 11, in which they are arranged essentially in a plane parallel to the glass roof 13.

The lamellae 5', which is arranged next to the end 11, is pivoted by a tape 15' which, as can be seen, has one end 15*a*' fastened at the top edge of the lamellae 5' and the other end 15*b*' fastened at the bottom edge of the lamellae 5'. The tape 15' is positioned over a crossmember 6. The rest of the tapes 15 are guided in each case over a top edge 5*a* of an adjacent lamellae 5. The tapes 15 and 15' may also be replaced by other suitable pulling means, for example by a cord, a cable or a chain.

Between the orientation according to FIG. 8 and that according to FIG. 10, all intermediate positions can be achieved in a stepless manner. When gathered from the position according to FIG. 10, the lamellae 5 are first of all pivoted into the vertical orientation shown in FIG. 8. As they are displaced further, the lamellae 5 are finally gathered into a group 7. The maximum distance between adjacent lamellae 5 is determined by spacers 9, which may likewise be tapes.

The lamellae 5 can be driven, as has already been mentioned, by hand or a motor. Automatic control for example on the basis of temperature sensors which are arranged in the interior 3 and/or the surroundings is also conceivable. The lamellae 5 are then in each case pivoted into the optimum position and gathered into a group 7. It is possible here for the two end positions according to FIGS. 5 to 7 and all the intermediate positions according to FIG. 6 to be set automatically.

The lamellae 5 are preferably fabric lamellae. It is also conceivable, however, for them to be configured, for example, from wood, plastic or sheet metal. The significant factor for the invention is that these lamellae 5 are retained and stabilized by the tapes 15, in particular, in the intermediate positions according to FIGS. 6 and 9. The lamellae 5 may thus also be comparatively long, for example a number of meters long. In this case, it is possible to provide a plurality of pivoting mechanisms 8 which act on the lamellae 5 at a distance apart from one another. On account of the high stability of the device, it is possible for the latter to be produced with a very low weight even in the case of large surface areas.

Figure 11:
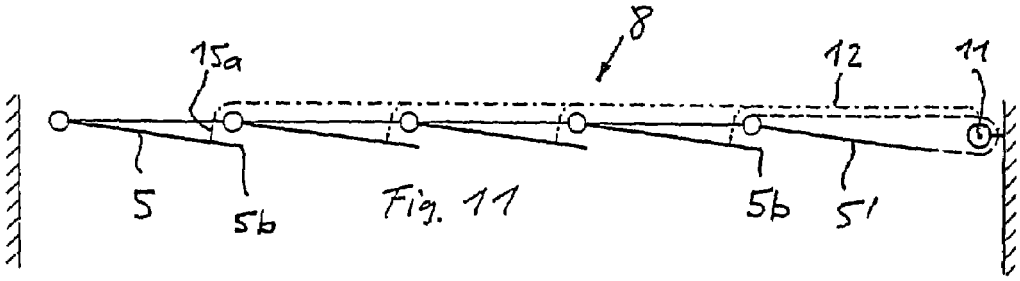
FIG. 11 shows a further view of the pivoting mechanism, the lamellae being pivoted essentially into one plane.
Figure 12:
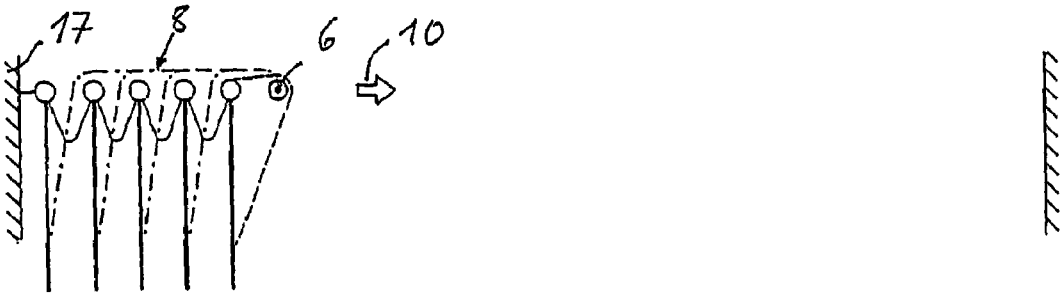
FIG. 12 shows a variant of the pivoting mechanism, the lamellae being gathered into a group.
Figure 13:
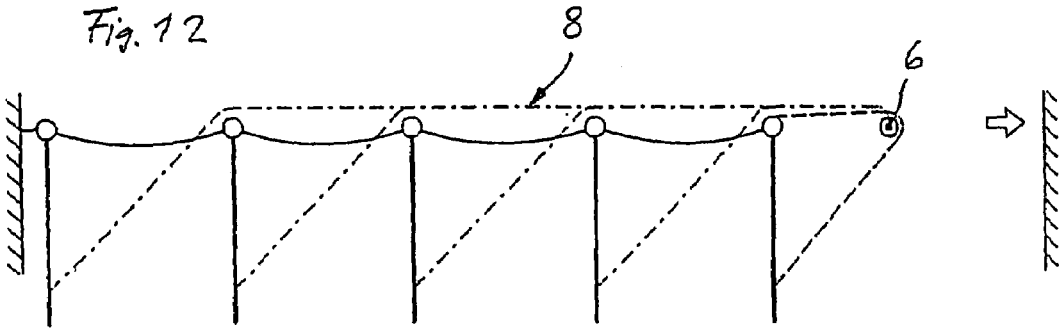
FIG. 13 shows the variant according to FIG. 12, but with the lamellae hanging vertically.
Figure 14:
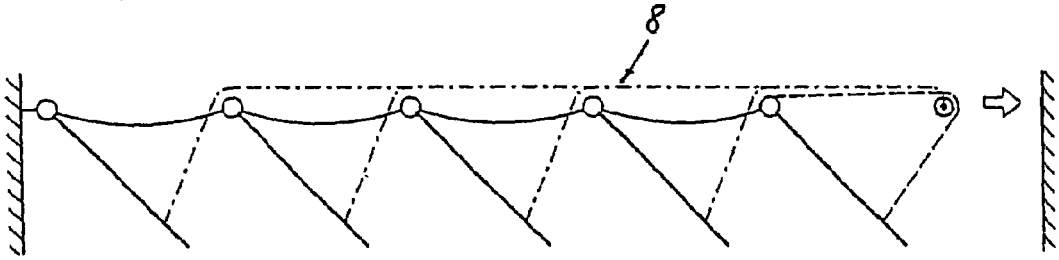
FIG. 14 shows the variant according to FIG. 12, the lamellae being inclined in relation to the roof surface.
Figure 15:
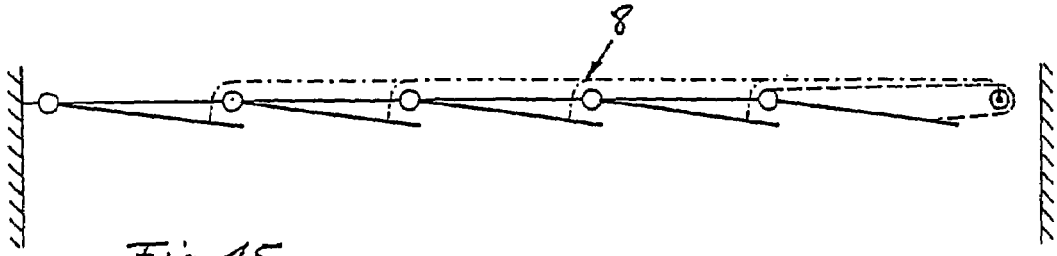
FIG. 15 shows the variant according to FIG. 12, the lamellae being pivoted essentially into one plane.

As FIG. 11 shows, the lamellae 5 and 5' overlap at the bottom periphery 5*b* in each case in the position shown here. The incidence of light can thus be avoided in a particularly reliable manner. For this purpose, the ends 15*a* are fastened on the lamellae 5 at some distance from the bottom periphery 5*b*.

FIGS. 12 to 15 show a variant in which the crossmember 6 is moved as the lamellae 5 are being drawn out. The moving crossmember 6 is thus not fastened directly on the building wall 17 as is the case with the configuration according to FIGS. 8 to 11. The operations of opening and closing and pivoting the lamellae 5, however, correspond, in principle, to the configuration described above.

Figure 16A:
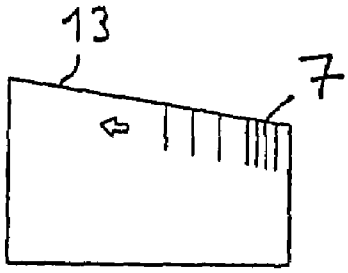
FIG. 16*a* shows, schematically, the operation of drawing out the lamellae, the latter being moved from bottom to top.
Figure 16B:
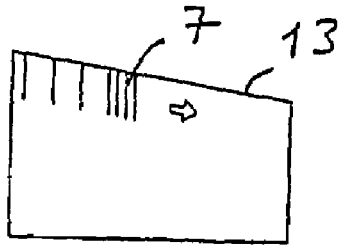
FIG. 16*b* shows, schematically, the operation of drawing out the lamellae, the group being moved from top to bottom.

FIGS. 16*a* and 16*b* show the device according to the invention arranged on an inclined roof 13. The inclination is usually between 15 and 35°. In the case of the configuration according to FIG. 16*a*, the lamellae are moved from right to left. The group 7 thus forms at the bottom right. In the case of the configuration according to FIG. 16*b*, the group 7 is formed at the top left. Mirror-inverted arrangements are also possible here.

Figure 5:
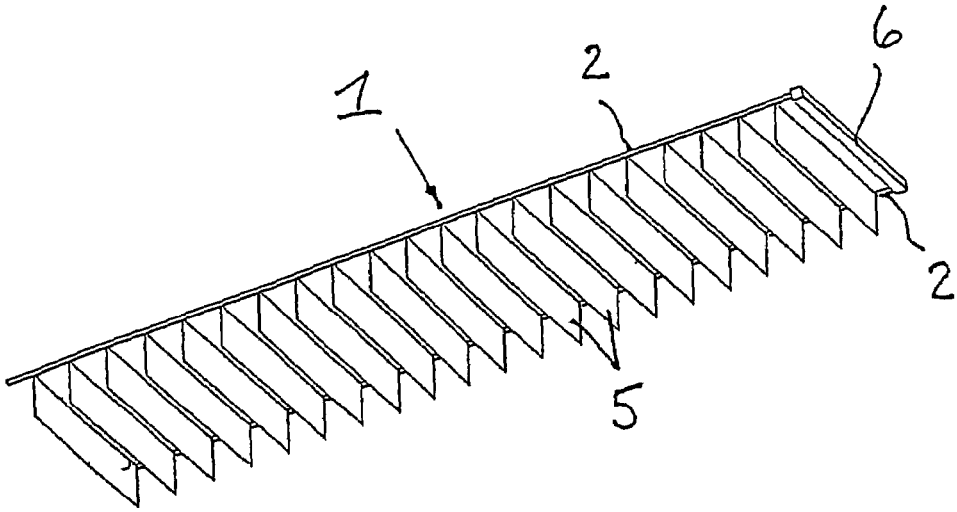
FIG. 5 shows, schematically, a three-dimensional view of the device according to the invention.
Figure 6:
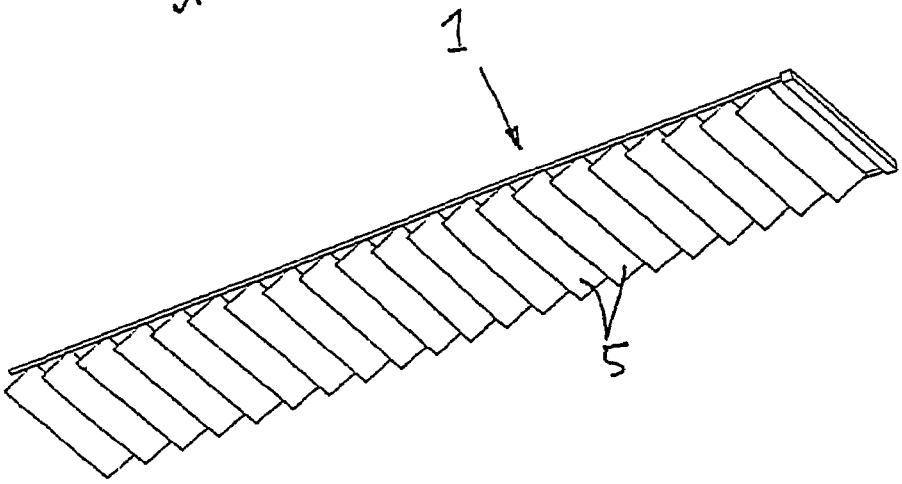
FIG. 6 shows, schematically, a three-dimensional view of the device according to the invention, the lamellae being pivoted.
Figure 7:
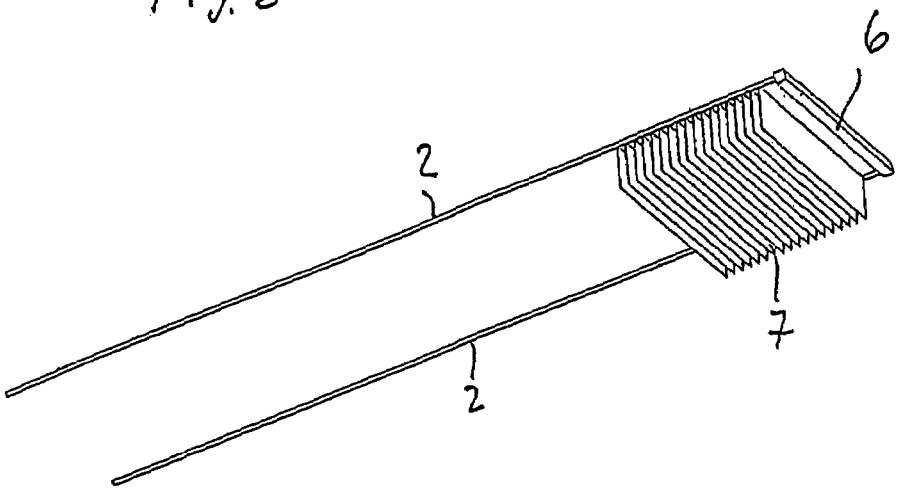
FIG. 7 shows a further three-dimensional schematic view of the device according to the invention, the lamellae being gathered into a group.

The lamellae 5 according to FIGS. 5 and 6 are all of the same length. However, a configuration in which the lamellae 5 are of different lengths is also conceivable. In this case, the guide rails 2 are preferably arranged above the lamellae. The lamellae 5 then project laterally on the guide rails 2. Trapezoidal and triangular devices are also possible with this arrangement.

The invention claimed is:

1. A device for providing shade inside rooms, having a plurality of lamellae oriented parallel to one another, an actuating means by which the lamellae can be pivoted, and a bearing arrangement on which the lamellae are mounted, wherein the lamellae are adapted to be gathered into a group and these lamellae are connected, for pivoting purposes, to a pivoting mechanism which has a first end and a plurality of further ends, wherein each further end is connected to a lamella such that, as the lamellae are being expanded along the bearing arrangement by means of a pulling arrangement in a parallel relationship, they are pivoted into a common plane by the pivoting mechanism, wherein the lamellae are mounted in a pivotable manner in each case at a top and essentially horizontal edge.

2. The device as claimed in claim 1, wherein the lamellae are mounted in a pivotable manner in each case at a top and essentially horizontal edge.

3. The device as claimed in claim 1, wherein the pivoting mechanism is fixed at the abovementioned first end.

4. The device as claimed in claim 1, wherein the lamellae are pivoted into a vertical plane for gathering.

5. The device as claimed in claim 1, wherein the abovementioned plurality of further ends are fastened on the lamella in each case at a distance from a bottom edge.

6. The device as claimed in claim 1, wherein the pivoting mechanism is guided over top edges of the lamellae.

7. The device as claimed in claim 1, wherein the lamellae are guided displaceably in rails at their ends in each case.

8. The device as claimed in claim 1, wherein spacers are arranged on the lamellae.

9. The device as claimed in claim 1, wherein the pivoting mechanism is produced from tapes.

10. The device as claimed in claim 1, wherein the guide rails are arranged above the lamellae and the lamellae are of different lengths, creating a trapezoidal or triangular arrangement when the lamellae are fully extended.

11. The device as claimed in claim 10, wherein the lamellae form a trapezoid when fully extended.

12. The device as claimed in claim 10, wherein the lamellae form a triangle when fully extended.

* * * * *